US006305177B1

(12) United States Patent
Edwards et al.

(10) Patent No.: US 6,305,177 B1
(45) Date of Patent: Oct. 23, 2001

(54) MOVABLE ICE GATE ASSEMBLY FOR A BEVERAGE DISPENSER SYSTEM

(75) Inventors: William A. Edwards, Lavernia; Randeep S. Grewal; Samuel Durham, both of San Antonio, all of TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 09/574,478

(22) Filed: May 19, 2000

Related U.S. Application Data

(60) Provisional application No. 60/135,887, filed on May 26, 1999.

(51) Int. Cl.[7] ..... F25C 5/18

(52) U.S. Cl. ..... 62/66; 62/344; 198/536; 222/146.6; 414/313

(58) Field of Search ..... 62/66, 344; 198/536, 198/360, 671; 222/146.6, 413, 522, 523, 553; 414/313, 317, 318, 319

(56) References Cited

U.S. PATENT DOCUMENTS 3,229,827 * 1/1966 Kucera ..... 214/17
3,269,517 * 8/1966 Skelton ..... 198/64
3,913,343 * 10/1975 Rowland et al. ..... 62/344
4,055,280 * 10/1977 Kohl et al. ..... 62/344
4,732,301 * 3/1988 Tobias et al. ..... 62/344
5,299,427 * 4/1994 Miller et al. ..... 62/66
5,752,393 * 5/1998 Schlosser et al. ..... 62/303

* cited by examiner

*Primary Examiner*—William E. Tapolcai
(74) *Attorney, Agent, or Firm*—Christopher L. Makay

(57) ABSTRACT

A dispensing system includes an ice supply unit for increasing the ice availability of the dispensing system and a moveable ice gate assembly coupled with the ice supply unit for transporting ice from the ice supply unit about the dispensing system. The dispensing system includes a dispensing system ice storage unit coupled with the movable ice gate assembly of the ice supply unit for receiving ice therefrom. The ice supply unit includes an ice supply unit housing, an ice collection bin disposed in the ice supply unit housing for receiving ice, and an automatic ice maker assembly positioned within the collection bin for supplying ice thereto. The movable ice gate assembly is positioned substantially centrally within the ice collection bin and includes a post for channeling ice therethrough and a movable gate unit linked and in movable engagement with the post for discharging ice received from the post out the movable ice gate assembly.

22 Claims, 7 Drawing Sheets

MOVABLE ICE GATE ASSEMBLY FOR A BEVERAGE DISPENSER SYSTEM

This application claims benefit of Provisional No. 60/135,887 filed May 26, 1999.

BACKGROUND OF THE INVENTION

1. Field of the Invention

The present invention generally relates to dispensing equipment and, more particularly, but not by way of limitation, to a beverage dispensing system featuring a movable ice gate assembly for facilitating increased ice capacity within existing spatial constraints.

2. Description of the Related Art

Beverage dispensing systems are equipped with a beverage dispenser unit for dispensing a variety of popular beverages therefrom. Additionally, beverage dispensing systems often provide ice to complement those beverages dispensed from the beverage dispenser unit in that consumers expect ice to accompany many of these popular carbonated and non-carbonated drinks.

However, providing a continuous supply of ice has long been problematic, especially if large volumes of consumers access a beverage dispensing system. Current beverage dispensing systems either require manual ice replenishment by a beverage dispensing system attendant or feature automatic ice makers of limited capacity.

In particular, beverage dispenser units include an ice collection bin for providing a supply of ice. Often, an attendant placing ice directly into the ice collection bin replenishes ice within the ice collection bin. In addition to being tedious and labor intensive, manual ice replenishment is hazardous in that consumers and beverage dispenser attendants alike trip and fall on ice that lands on the floor during the replenishment process. Furthermore, manual ice replenishment is less than sanitary due to ice contact with the atmosphere, the ice collection bin, and even the beverage dispenser attendant.

U.S. Pat. No. 3,211,338, which issued to A. G. Weil et al. on Oct. 12, 1965 and is entitled "Ice Handling Apparatus", features a beverage dispensing system with an automatic ice maker. The Weil ice maker is confined within the inner workings of a beverage dispenser unit and, thus, cannot accommodate the unit's ice collection bin with large volumes of ice at any given time. Furthermore, merely entertaining the notion of integrating an additional automatic ice maker within an existing beverage dispenser unit is unduly troublesome in that beverage dispensing systems are often situated in commercial settings with little space for accommodating ice capacity expansion.

The Weil ice maker imposes a further complication in that it does not include an integrated sanitizing system, which necessitates manual cleaning. Consequently, the Weil ice maker is not suited for placement in a confined space, such as under a counter.

Accordingly, there is a long felt need for a self-sanitizing beverage dispensing system that provides increased ice capacity within existing spatial constraints.

SUMMARY OF THE INVENTION

In accordance with the present invention, a dispensing system includes a dispensing system ice storage unit, an ice supply unit for increasing ice availability of the dispensing system, and a movable ice gate assembly coupled with the ice supply unit for transporting ice from the ice supply unit about the dispensing system. The ice supply unit includes an ice supply unit housing, an ice collection bin disposed in the ice supply unit housing for receiving ice, and an automatic ice maker assembly positioned within the collection bin for supplying ice thereto. The ice supply unit further includes an external ice inlet linked and in engagement with the ice collection bin for receiving ice from an external source.

The movable ice gate assembly is positioned substantially centrally within the ice collection bin to transfer ice from the ice collection bin, out the ice supply unit, and about the dispensing system. The movable ice gate assembly includes a post for channeling ice therethrough and a movable gate unit linked and in movable engagement with the post for discharging ice received from the post out the movable ice gate assembly and about the dispensing system. The movable ice gate assembly further includes an ice channeling element disposed in the post for carrying ice therethrough. The movable gate unit includes an ice applicator chute in communication with the post and a chute sleeve disposed on and in extendible engagement with the ice applicator chute for varying the length of the movable ice gate unit. The post includes a post opening for facilitating ice transfer from the post to the movable gate unit and a trap door in cooperative engagement with the post opening for selectively regulating ice flow through the post opening.

The dispensing system further includes an ice dispenser unit for delivering ice from the dispensing system. The ice dispenser unit includes an ice dispenser assembly linked and in cooperative engagement with the ice supply unit, whereby ice is delivered from ice supply unit to the ice dispenser assembly. The ice dispenser assembly includes an ice dispenser housing secured atop the ice supply unit housing, an ice dispenser post linked and in communication with the movable ice gate assembly for channeling ice received from the movable ice gate assembly, and an ice dispensing outlet disposed on and extending through the ice dispenser housing for discharging ice received from the dispenser post out the ice dispenser assembly. The ice dispenser assembly further includes an ice dispenser channeling element for carrying ice through the ice dispenser assembly disposed in the ice dispenser housing and in cooperative engagement with the ice channeling element of the movable ice gate assembly. The dispenser post includes an ice dispenser post opening for facilitating ice transfer from the ice dispenser post to the ice dispensing outlet and an ice dispenser trap door in cooperative engagement with the ice dispenser post opening for selectively regulating ice flow through the ice dispenser post opening.

The dispensing system further includes a logic control unit for selectively engaging the ice channeling element, the trap door, the ice dispenser channeling element, and the ice dispenser trap door to facilitate ice delivery from the ice supply unit and the ice dispenser unit. The dispensing system still further includes a sanitizing system in cooperative engagement with the ice supply unit and the dispensing system ice storage unit for preventing the unfavorable build-up of contaminants therein and a water treating system coupled with the automatic ice maker assembly for supplying treated water thereto.

It is therefore an object of the present invention to provide a dispensing system with increased ice capacity through an ice supply unit configurable in a variety of arrangements that occupy the least space possible.

It is another object of the present invention to provide an ice supply unit with a movable gate assembly positionable to allow engagement of the ice supply unit with a dispensing system ice storage unit.

It is a further object of the present invention to provide an ice supply unit with an improved automatic ice maker assembly.

Still other objects, features, and advantages of the present invention will become evident to those of ordinary skill in the art in light of the following.

BRIEF DESCRIPTION OF THE DRAWINGS

FIG. 2 illustrates a movable ice gate assembly incorporated in an ice supply unit 200 for a beverage dispensing system.

FIG. 3 illustrates a movable ice gate assembly incorporated in an ice supply unit for a beverage dispensing system.

FIG. 7 illustrates an L-shaped evaporator coil from an ice supply unit.

DETAILED DESCRIPTION OF THE PREFERRED EMBODIMENT

As required, detailed embodiments of the present invention are disclosed herein, however, it is to be understood that the disclosed embodiments are merely exemplary of the invention, which may be embodied in various forms, the figures are not necessarily to scale, and some features may be exaggerated to show details of particular components or steps.

FIGS. 1–5 show a movable ice gate assembly 100 incorporated in a beverage dispensing system 1 for transporting ice about the beverage dispensing system 1. As such, an ice channeling element is disposed within the movable ice gate assembly 100 for carrying ice therethrough.

Although shown in FIGS. 1–5 as an auger shaft 150, as is preferred, the ice channeling element may be any suitable means for delivering ice through the movable ice gate assembly 100 as those of ordinary skill in the art will recognize. It should be added that the auger shaft 150 is turned by an auger driver 160, preferably comprising a standard motor well known in the industry.

Figure 1:
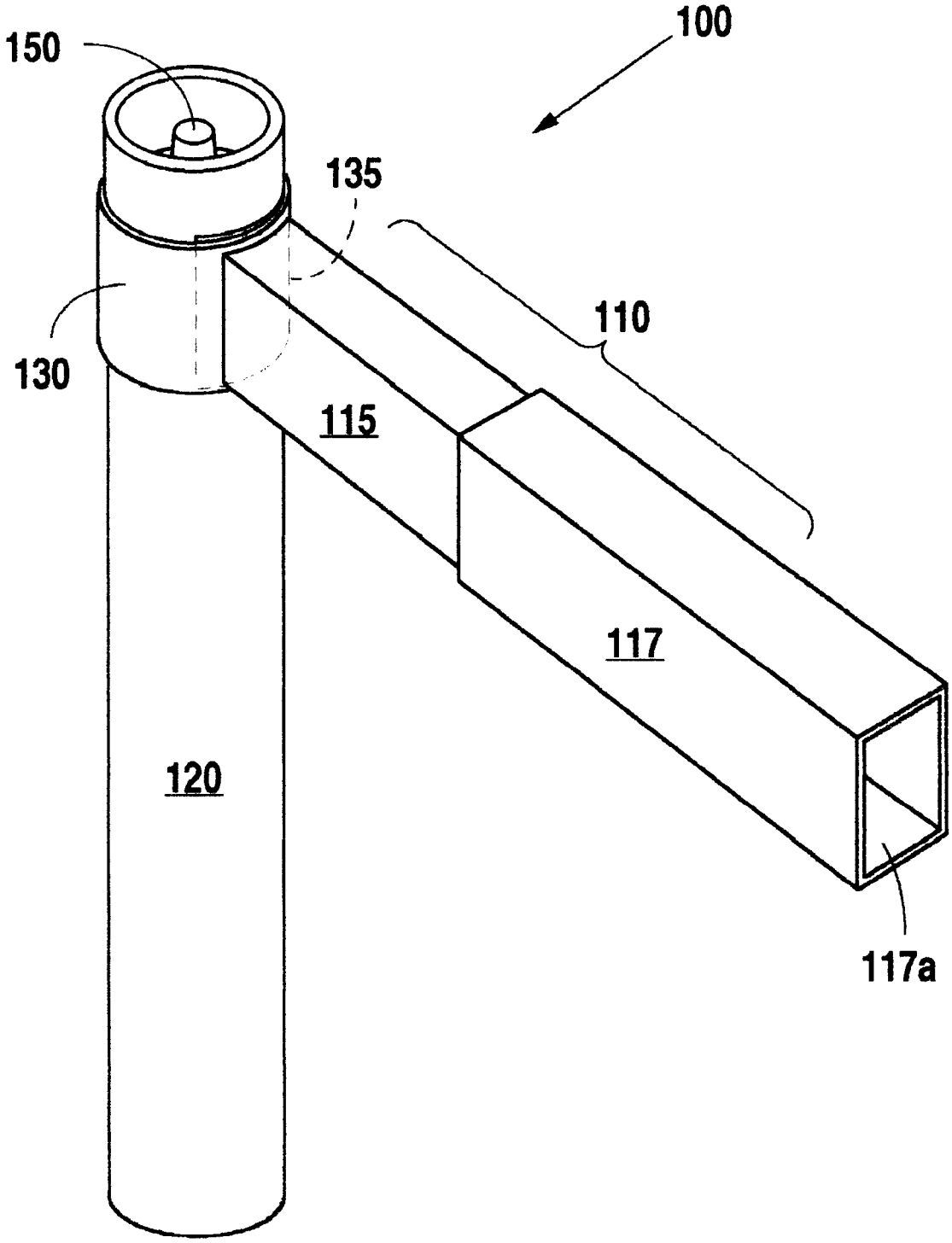
FIG. 1 is a perspective view illustrating a movable ice gate assembly according to the preferred embodiment for transporting ice about a beverage dispensing system.

In FIG. 1, the movable ice gate assembly 100 includes an auger post 120 where ice is channeled therethrough. Inasmuch, the auger shaft 150 extends along the auger post 120 for directing ice generally upward. Specifically, auger threads 155 are provided along the auger shaft 150 to carry ice upward via a "screw effect".

The movable ice gate assembly 100 includes a movable gate unit 110 coupled to and in communication with the auger post 120, whereby ice from the auger post 120 is transferred through the movable gate unit 110. As shown in FIG. 1, a chute collar 130 is mounted over the movable gate unit 110 in movable engagement about the auger post 120 or, alternatively, the chute collar 130 and the movable gate 110 could be formed integrally. Although those of ordinary skill in the art will recognize other suitable and equivalent means for transferring ice through the movable gate unit 110, it should be added that the movable gate unit 110 is preferably linked with the auger post 120 at a suitable angle to thus subject ice to gravity flow through the movable gate unit 110.

Figure 3A:
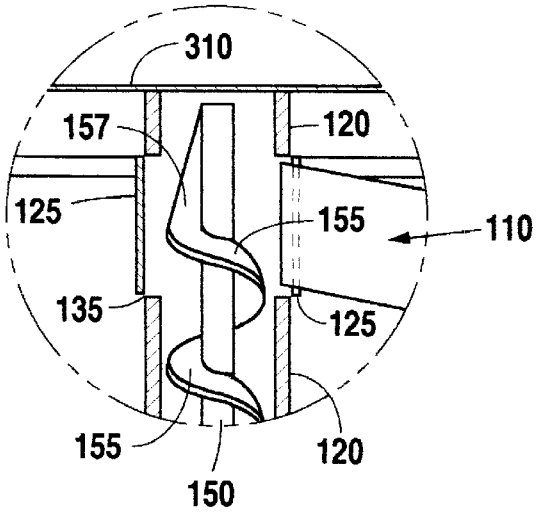
FIG. 3*a* is a detailed view of the movable gate assembly within the ice supply unit.

The auger post 120 forms at least one post opening 135 for facilitating ice transfer from the auger post 120 to the movable gate unit 110. Furthermore, as discussed in detail below, FIG. 3*a* depicts a trap door 125 in respective engagement with the post opening 135 that may be provided by the movable ice gate assembly 100 to selectively regulate ice flow through the post opening 135.

As shown in FIGS. 2–5, an ice collection member 157 may be provided atop the auger shaft 150 to facilitate ice transfer. Operatively illustrated in FIG. 3*a*, as the auger shaft 150 turns, the ice collection member 157 shovels the ice arriving upwardly through the auger post 120 into the movable gate unit 110.

The movable gate unit 110 includes an ice applicator chute 115 operatively linked and in communication with the auger post 120. The ice applicator chute 115 features an applicator chute passageway 115*a* for transferring ice from the auger post 120 through the movable gate unit 110.

The movable gate unit 110 may further include a chute sleeve 117 positioned about the ice applicator chute 115. In the preferred embodiment, the chute sleeve 117 telescopes outwardly from the ice applicator chute 115 to adjust the length of the movable gate unit 110, thereby allowing a movable gate unit to compensate for spatial variations within a beverage dispensing system. As such, the chute sleeve 117 features a chute sleeve passageway 117*a* in communication with the applicator chute passageway 115*a* for transferring ice from the auger post 120 through the movable gate unit 110.

Operatively, in summation, ice travels upwardly through the auger post 120 via the ice channeling element. Accordingly, ice from the post opening 135 enters the movable gate unit 110 and is preferably subjected to gravity flow across the applicator chute passageway 115*a* and the chute sleeve passageway 117*a*.

Figure 2A:
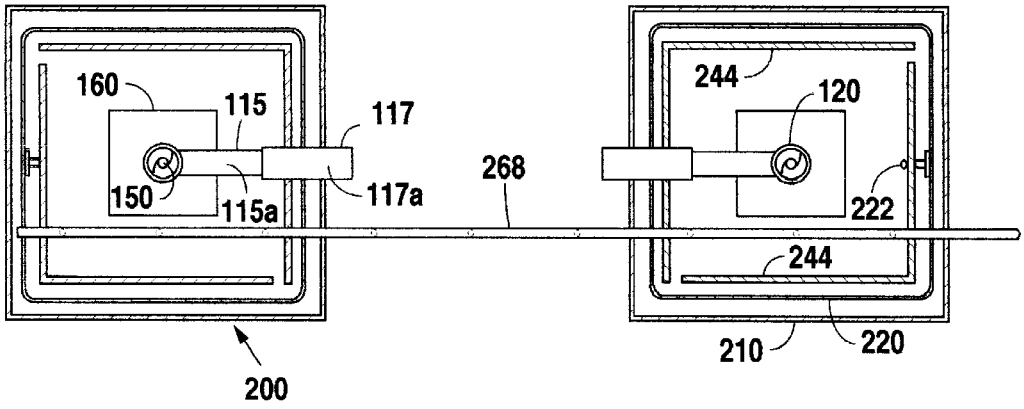
FIG. 2*a* is a top view showing the movable ice gate assembly incorporated within each ice supply unit for the beverage dispensing system.
Figure 2B:
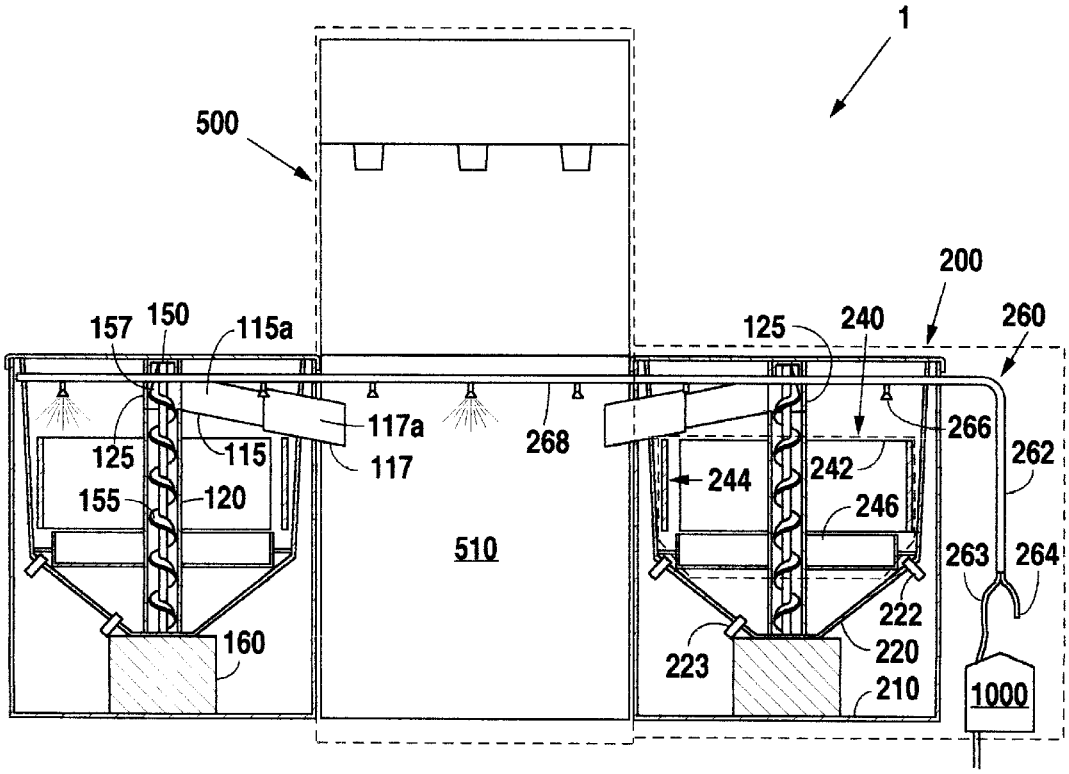
FIG. 2*b* is a side view of the beverage dispensing system featuring two ice supply units for supplying ice to the beverage dispenser unit. The beverage dispenser unit receives ice from the ice supply units as well as dispenses a desired beverage therefrom.

In reference to FIG. 2, the movable ice gate assembly 100 is incorporated within each ice supply unit 200 for the beverage dispensing system 1. As such, the beverage dispensing system 1 includes a beverage dispenser unit 500 for dispensing a desired beverage therefrom. The beverage dispenser unit 500, in turn, includes a beverage dispenser ice storage chamber 510, well known in the industry, for storing ice received from a source, such as from manual replenishment, from an automatic ice maker of limited capacity or, preferably, from an ice supply unit 200 linked thereto. An ice agitator (not shown) may be provided within the beverage dispenser ice storage chamber 510 to ensure a steady flow of ice within the beverage dispenser ice storage chamber 510. Additionally, the beverage dispenser unit 500 includes a beverage dispenser ice channeling element (not shown), such as an auger, a paddle wheel, and the like, well known to those of ordinary skill in the art, operatively engaged with the ice in the beverage dispenser ice storage chamber 510 for, ultimately, delivering ice from the beverage dispenser ice storage chamber 510 to an end user.

It should be emphasized that although two ice supply units 200 are shown in FIG. 2, those of ordinary skill in the art will recognize that any number of ice supply units to satisfy demand will suffice. Furthermore, due to its movable gate unit 110 and telescoping chute sleeve 117, the movable ice gate assembly 100 enables an ice supply unit to become operatively linked with a beverage dispenser unit in a variety of spatial directions and rotations—especially in commercial settings with little space for accommodating ice capacity expansion.

Each ice supply unit 200 includes an ice supply unit housing 210. The ice supply housing 210 is preferably configured to house a single ice supply unit, thereby facilitating attachment with the beverage dispenser unit 500 by abutment thereto as shown in FIG. 2. The ice supply unit 200 includes an ice collection bin 220 disposed therein and includes an automatic ice maker assembly 240 positioned within the ice collection bin 220 for supplying ice to the ice collection bin 220. To optimize the quantity of ice collected by the ice collection bin 220, the movable ice gate assembly 100 is positioned substantially centrally within the ice collection bin 220 as is preferred.

The automatic ice maker assembly 240 includes at least one L-shaped evaporator unit 244 and includes a corresponding ice formation plate 242 positioned along the L-shaped evaporator unit 244 for transferring heat to the L-shaped evaporator unit 244, thereby forming ice on the ice formation plate 242. In particular, the ice formation plate 242 defines an array of ice cube molds (not shown) that are subjected to freezing temperatures by the L-shaped evaporator unit 244. While the automatic ice maker assembly 240 is in operation, water is continuously passed over the frozen molds to form ice cubes. Once ice cubes are sufficiently formed, the molds are heated by the L-shaped evaporator unit 242 via a reverse refrigeration process, and the ice cubes are accordingly dropped from the ice formation plate 242 to accumulate within the ice collection bin 220. Excess unfrozen water is collected by a drainage pan 246 positioned below the L-shaped evaporator unit 244 and discharged from the ice collection bin 220 via a drainage outlet 222.

Figure 7A:
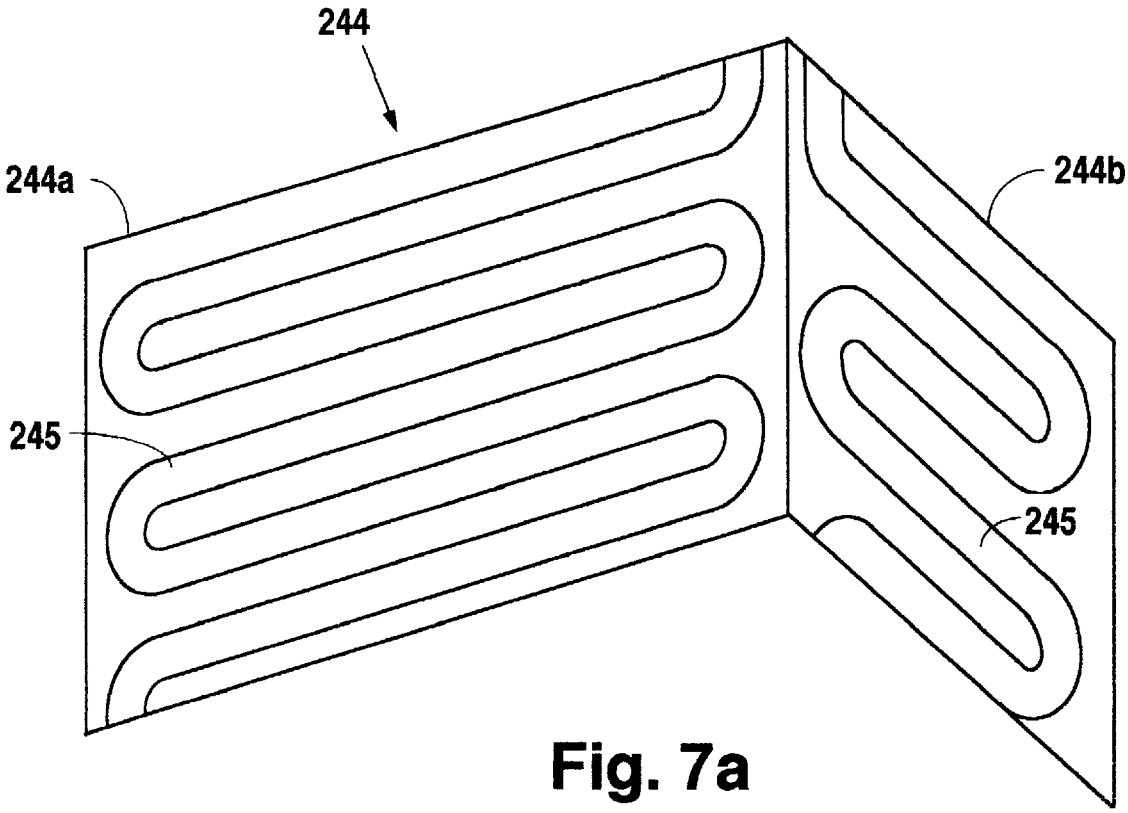
FIG. 7*a* is a perspective view of the L-shaped evaporator coil formed by a pair of evaporator panels.
Figure 7B:
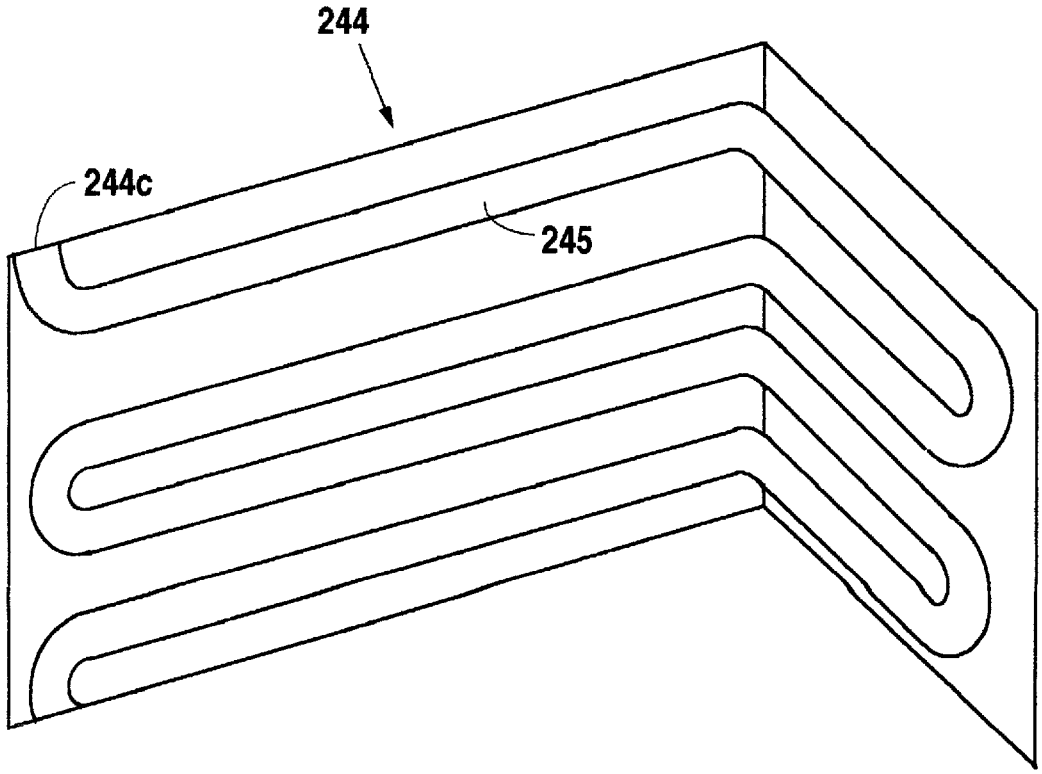
FIG. 7*b* is a perspective view of the L-shaped evaporator coil formed from a single evaporator panel.

Specifically, as shown in FIG. 7, a refrigeration coil 245 is provided by the L-shaped evaporator unit 244 for receiving refrigerant fluid from a standard refrigeration unit (not shown), thereby drawing heat from the ice formation plate 242 to form ice. The L-shaped evaporator coil can either be constructed from a first evaporator panel 244*a* and a second evaporator panel 244*b* coupled together as in FIG. 7*a* or from a single evaporator panel 244*c* as in FIG. 7*b*.

As shown in FIG. 2*a*, the L-shaped evaporator unit 242 is uniquely configured to optimize ice storage space within the ice collection bin 220 and, hence, an "L" shape suitable for placement along the outer periphery of the ice collection bin 220. The L-shaped evaporator unit 242 is configured to accommodate the movable ice gate assembly 100 as preferably positioned substantially centrally within the ice collection bin 220.

To remove unhealthy build up of microorganisms and unfavorable impurities associated with ice from the automatic ice maker assembly 240, the beverage dispensing system 1 includes an ice sanitizing system 260 in operative engagement with the beverage dispenser unit 500 as well as with each ice supply unit 200. The ice sanitizing system 260 includes a main sanitizing system line 268 passing along the beverage dispenser unit 500 and each ice supply unit 200. The main sanitizing system line 268 may include spray nozzles 266 for discharging a sanitizing mixture therefrom. A sanitizing system inlet 262 linked with the main sanitizing system line 268 is provided by the ice sanitizing system 260 for receiving water and sanitizing solution via a water inlet 263 and a sanitizing solution inlet 264. The sanitizing system inlet 262 provides for easy insertion and removal from the main sanitizing line 268. To avoid interfering with the movable gate unit 110, the sanitizing system inlet 262 is connected with the main sanitizing line 268 in the ice supply unit 200 at a sufficient distance away from the moveable gate unit 110.

In operation, water first enters the water inlet 263 from its source (not shown) and is introduced into the main sanitizing line 268, thereby flushing the beverage dispensing system 1. Next, water and sanitizing solution enter the water inlet 263 and the sanitizing solution inlet 264, respectively, from their sources (not shown) and are each introduced into the main sanitizing line 268, thereby mixing and forming the sanitizing mixture. The sanitizing mixture is discharged from the main sanitizing line 268 to disinfect the beverage dispensing system 1. Finally, water again enters the water inlet 263 from its source and is introduced into the main sanitizing line 268 to flush-out the beverage dispensing system 1. Excess sanitizing mixture and water are thus discharged from the beverage dispensing system 1 via a drainage outlet 223. Although sanitizing solution is combined with water to obtain the sanitizing mixture, other embodiments contemplate obtaining a sanitizing mixture from a premixed sanitizing mixture source.

Furthermore, to remove impurities from water utilized in making ice, the beverage dispensing system 1 of FIG. 2 may include a water treatment system 1000. Impurities in the water, such as calcium, precipitate from the water as it flows through the automatic ice maker assembly 240 during the ice making process. The precipitated impurities build-up on the inner surfaces of the automatic ice maker assembly 240 and clog the automatic ice maker assembly 240, thus causing costly and time consuming cleaning thereof The water treatment system 1000 therefore removes these impurities to prevent clogging of the automatic ice maker assembly 240. The water treatment system 1000 may be any system suitable for removing impurities and is preferably a water treating apparatus as disclosed in U.S. Pat. No. 5,318,702, which issued to Ashbrook on Jun. 7, 1994, and U.S. Pat. No. 5,435,913, which issued to Ashbrook on Jul. 25, 1995, the disclosures of which are herein incorporated by reference.

Figure 3B:
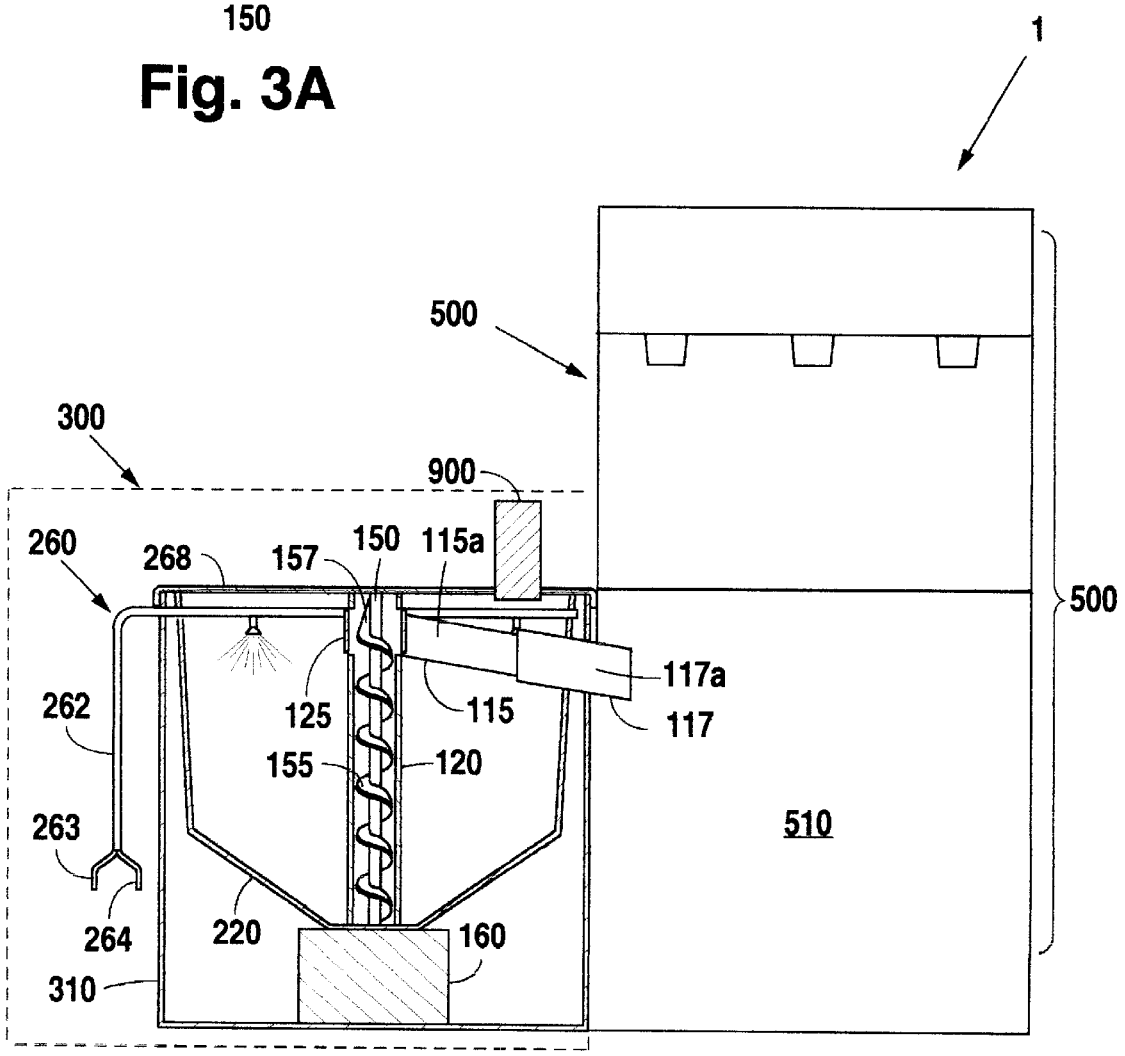
FIG. 3*b* is a side view of the beverage dispensing system featuring the ice supply unit for increasing ice availability.
Figure 4:
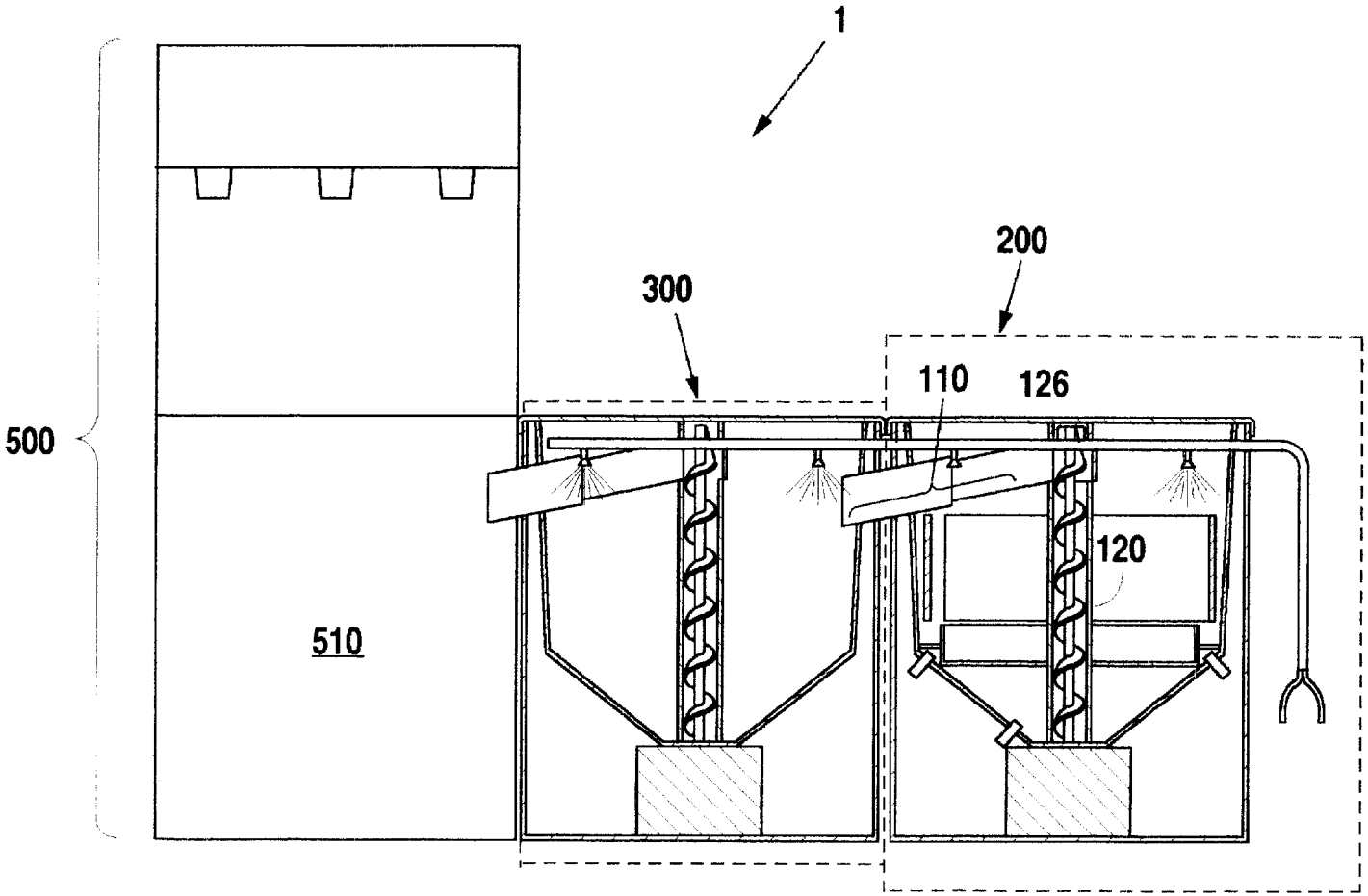
FIG. 4 is a side view illustrating a movable ice gate assembly incorporated within a beverage dispensing system featuring ice supply units.

Referring to FIG. 3, the movable ice gate assembly 100 is incorporated within an ice supply unit 300 of the beverage dispensing system 1 for increasing ice availability. The ice supply unit 300 is structurally identical to the ice supply unit 200 except that it does not include an automatic ice maker assembly 240 as with the ice supply unit 200. Inasmuch, ice is delivered to the ice supply unit 300 via an external ice inlet 900 in operative engagement with a corresponding ice supply unit housing 310. As shown in the beverage dispensing system 1 of FIG. 4, the external ice inlet 900 may comprise a movable ice gate assembly from an ice supply unit.

Figure 5:
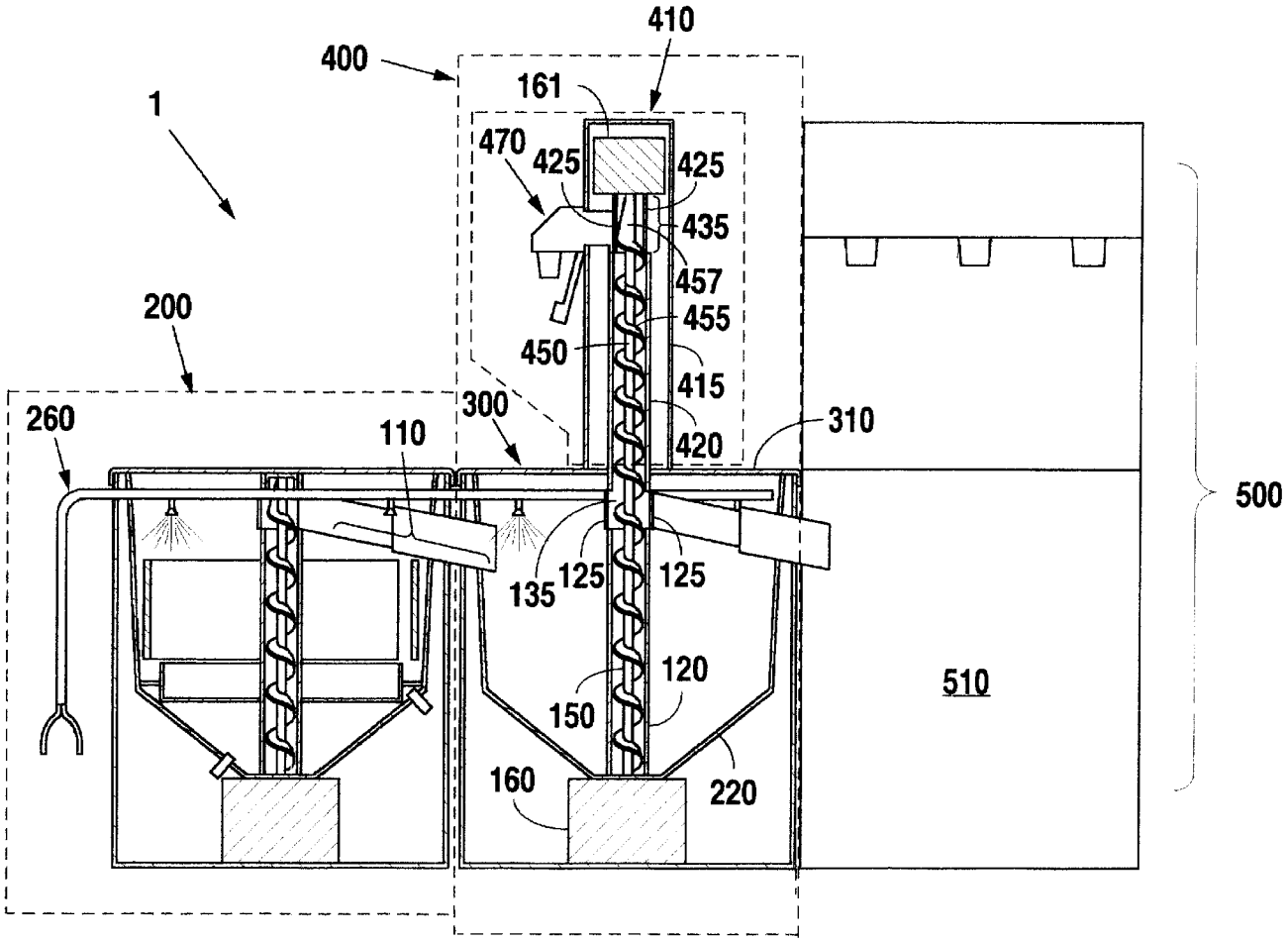
FIG. 5 is a side view illustrating a beverage dispensing system featuring an ice dispenser unit for supplying ice to the beverage dispenser unit as well as directly to a user.

The beverage dispensing system 1 of FIG. 5 includes an ice dispenser unit 400 interposed with the ice supply unit 200 and the beverage dispenser unit 500. The ice dispenser unit 400 provides a supply of ice to the beverage dispenser ice storage chamber 51 0 as well as provides a supply of ice directly to a user via an ice dispenser assembly 410. Although FIG. 5 shows the ice dispenser unit 400 formed by coupling the ice dispenser assembly 410 with the ice supply unit 300, other embodiments contemplate an ice dispenser unit 400 formed by coupling an ice dispenser assembly with an ice supply unit.

In particular, the ice dispenser assembly 410 includes an ice dispenser housing 415 secured atop the ice supply unit housing 310. An ice dispenser ice channeling element is disposed in the ice dispenser housing 415 and in operative engagement with the ice channeling element of the movable ice gate assembly 100 of the ice supply unit 300, thereby each cooperatively carrying ice through the ice dispenser unit 400. Although shown in FIG. 5 as an ice dispenser auger shaft 450, as is preferred, the ice dispenser ice channeling element may be any suitable means for delivering ice through the ice dispenser assembly 410 as those of ordinary skill in the art will recognize. It should be added that the ice dispenser auger shaft is turned by an ice dispenser auger driver 161, preferably comprising a standard motor well known in the industry. Therefore, although operatively linked with one another as discussed in detail below, it must be emphasized that in this preferred embodiment the auger shaft 120 and the ice dispenser auger shaft 450 are not physically connected but are each driven separately or in tandem while in operation to carry ice along the ice dispenser unit 400. Nevertheless, those of ordinary skill in the art will recognize that the auger shaft 120 and the ice dispenser auger shaft 420 could be coupled with a clutch disengaged to permit ice delivery to the beverage dispenser ice storage chamber 510 and engaged to permit ice flow across the ice dispenser assembly 410.

In FIG. 5, the ice dispenser assembly 410 includes an ice dispenser auger post 420 linked and in communication with the ice supply unit's 300 auger post 120, whereby ice from auger post 120 is received and channeled therethrough. Inasmuch, the ice dispenser auger shaft 450 extends along the ice dispenser auger post 420 for directing ice from the ice supply unit's 300 auger shaft 150 generally upward. Ice dispenser auger threads 455 are provided along the ice dispenser auger shaft 450 to carry ice upward via a "screw effect".

The ice dispenser assembly 410 includes an ice dispensing outlet 470 disposed on and extending through the ice dispenser housing 415. Thus, in operation, ice from the ice dispenser auger post 420 is transferred through the ice dispensing outlet 470 and discharged from the ice dispenser assembly 410 directly to a user, i.e. a cup positioned near the ice dispensing outlet 470. The ice dispenser auger post 420 forms at least one ice dispenser auger post opening 435 for facilitating ice transfer from the ice dispenser auger post 420 to the ice dispensing outlet 470. An ice dispenser trap door 425 in respective engagement with the ice dispenser auger post opening 435 is preferably provided to selectively regulate ice flow through the ice dispenser auger post opening 435. Moreover, an ice dispenser ice collection member 457 may be provided atop the ice dispenser auger shaft 450 to facilitate ice transfer from the ice dispenser auger post 420 to the ice dispensing outlet 470.

Figure 6:
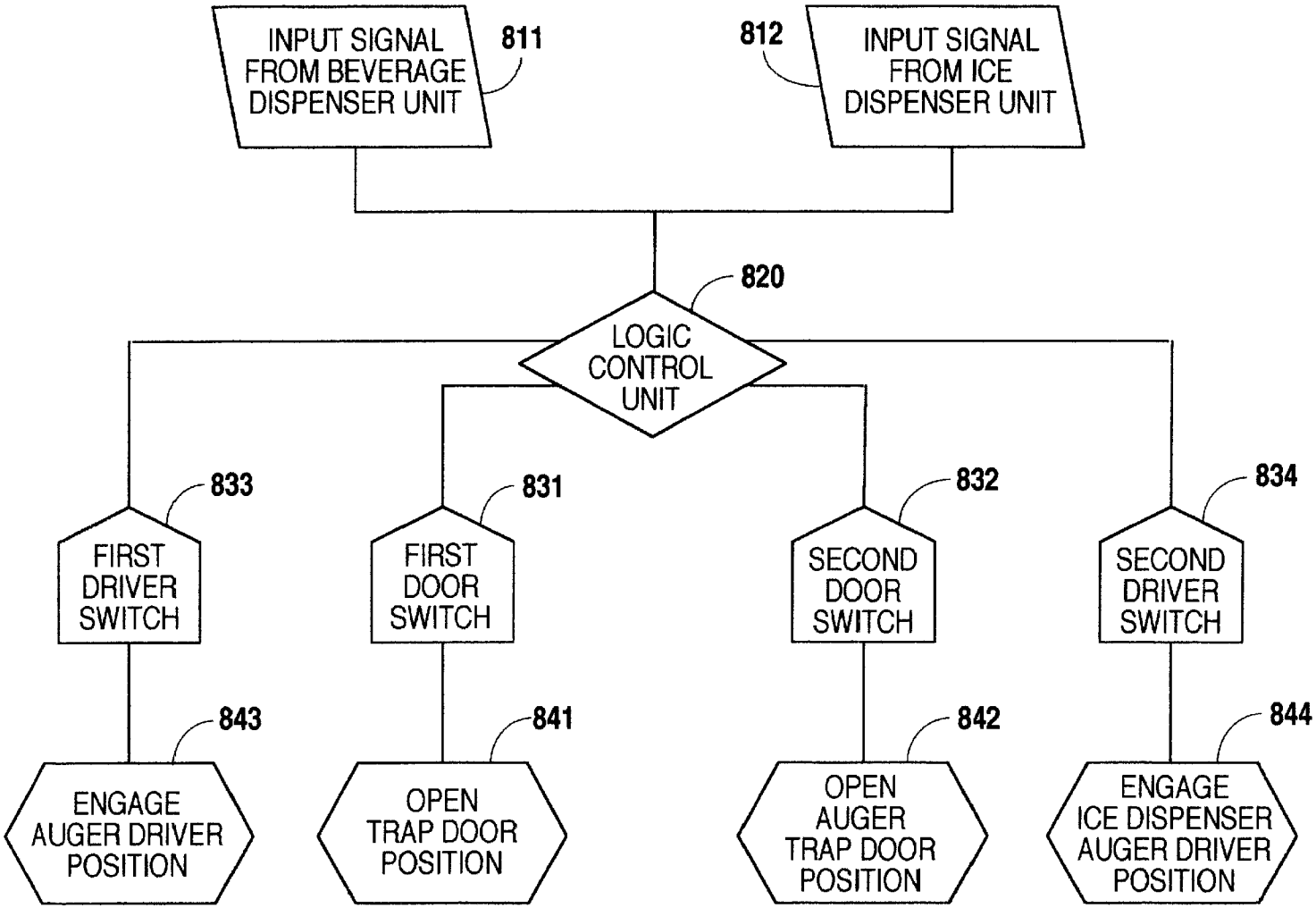
FIG. 6 is a schematic diagram illustrating the operation of the ice dispenser unit of FIG. 5.

The ice dispenser unit 400 includes a logic control unit 820 electrically linked with the trap door 125 and the auger trap door 425 as well as the auger driver 160 and the ice dispenser auger driver 161. As shown in FIG. 6, the logic control unit 820, which is any suitable microcontroller and/or associated circuitry, administers ice flow from the ice collection bin 220 to the beverage dispenser ice storage chamber 510 and/or to the ice dispensing outlet 470.

Thus, in FIG. 5, while the ice dispenser unit 400 is inactive, the associated trap door 125 and the auger trap door 425 close off the post opening 135 and the ice dispenser auger post opening 435, respectively, from the flow of ice through the auger post 120 and the ice dispenser auger post 420. When ice is desired, the logic control unit 820 activates the auger shaft 150 and/or the ice dispenser auger shaft 450 via the auger driver 160 and the ice dispenser auger driver 161, respectively. Thus, ice is channeled upward from the ice collection bin 220 through the auger post 120 and/or the ice dispenser auger post 420.

In FIG. 6, the logic control unit 820, via an input signal, determines whether ice is desired by the ice dispenser unit 400 and/or the beverage dispenser unit 500. As those of ordinary skill in the art will recognize, the input signal may be generated by a manual switch associated with the ice dispenser assembly 410 and/or an ice level sensor associated with the beverage dispenser ice storage chamber 510. The logic control unit 820 generates a corresponding door signal to open the desired trap door 125 and/or the auger trap door 425. Accordingly, ice flows from the trap door 125 through the movable gate unit 110 to the beverage dispenser ice storage chamber 510 and/or flows from the auger trap door 425 through and out the ice dispensing outlet 470.

Illustratively, if the beverage dispenser ice storage chamber 510 needs replenishing, the logic control unit 820 receives an input signal 811 from the beverage dispenser unit 500. The logic control unit 825 generates a corresponding first driver signal that closes a first driver switch 833. The first driver switch 833 receives the first driver signal and implements an engage auger driver position 843 to activate the auger driver 160. Moreover, the logic control unit 825 generates a corresponding first door signal. The first door switch 831 receives the first door signal and implements an open trap door position 841 on the trap door 125, thereby permitting ice flow from the auger post 120 through the movable gate unit 110.

In a similar manner, if a user accesses the ice dispensing outlet 470, the logic control unit 820 receives an input signal 812 from the ice dispenser unit 400. The logic control unit 825 generates a second driver signal that closes a second driver switch 834. Inasmuch, an engage ice dispenser auger driver position 844 is implemented to thus activate both the auger driver 160 and the ice dispenser auger driver 161. The logic control unit 820 further generates a second door signal. The second door switch 832 receives the second door signal and implements an open auger trap door position 842 on the auger trap door 425, thereby permitting ice flow from the auger post 120 and the ice dispenser auger post 420 through the ice dispensing outlet 470. It should be understood that the trap door 125 remains closed while ice is discharged from the ice dispensing outlet 470.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A movable ice gate assembly for a dispensing system, comprising:

a post for channeling ice therethrough; and a movable gate unit linked and in movable engagement with the post for discharging ice received from the post out the movable ice gate assembly to a desired location, the movable gate unit, comprising:

an ice applicator chute in communication with the post, and a chute sleeve disposed on and in extendible engagement with the ice applicator chute for varying the length of the movable ice gate unit.

2. The movable ice gate assembly according to claim 1, further comprising an ice channeling element disposed in the post for carrying ice therethrough.

3. The movable ice gate assembly according to claim 1, wherein the post includes:

a post opening for facilitating ice transfer from the post to the movable gate unit; and a trap door in cooperative engagement with the post opening for selectively regulating ice flow through the post opening.

4. A dispensing system, comprising:

an ice supply unit for increasing ice availability of the dispensing system; and a movable ice gate assembly coupled with the ice supply unit for transporting ice from the ice supply unit about the dispensing system, the movable ice gate assembly, comprising:

a post for channeling ice therethrough, and a movable gate unit linked and in movable engagement with the post for discharging ice received from the post out the movable ice gate assembly and about the dispensing system, the movable gate unit, comprising:

an ice applicator chute in communication with the post; and a chute sleeve disposed on and in extendible engagement with the ice applicator chute for varying the length of the movable ice gate unit.

5. The dispensing system according to claim 4, wherein the ice supply unit comprises:

an ice supply unit housing; and an ice collection bin disposed in the ice supply unit housing for receiving ice.

6. The dispensing system according to claim 3, wherein the ice supply unit further comprises an external ice inlet linked and in engagement with the ice collection bin for receiving ice from an external source.

7. The dispensing system according to claim 3, wherein the ice supply unit further comprises an automatic ice maker assembly positioned within the collection bin for supplying ice thereto.

8. The dispensing system according to claim 7, wherein the automatic ice maker assembly comprises an L-shaped evaporator coil positioned along the periphery of the ice collection bin for facilitating the formation of ice thereof.

9. The dispensing system according to claim 5, wherein the movable ice gate assembly is positioned substantially centrally within the ice collection bin to transfer ice from the ice collection bin, out the ice supply unit, and about the dispensing system.

10. The dispensing system according to claim 4, wherein the movable ice gate assembly further comprises an ice channeling element disposed in the post for carrying ice therethrough.

11. The dispensing system according to claim 4, wherein the post includes:

a post opening for facilitating ice transfer from the post to the movable gate unit; and a trap door in cooperative engagement with the post opening for selectively regulating ice flow through the post opening.

12. The dispensing system according to claim 11, further comprising an ice dispenser unit for delivering ice from the dispensing system.

13. The dispensing system according to claim 12, wherein the ice dispenser unit comprises an ice dispenser assembly linked and in cooperative engagement with the ice supply unit, whereby ice is delivered from ice supply unit to the ice dispenser assembly.

14. The dispensing system according to claim 13, wherein the ice dispenser assembly comprises:

an ice dispenser housing secured atop the ice supply unit housing;

an ice dispenser post linked and in communication with the movable ice gate assembly for channeling ice received from the movable ice gate assembly; and an ice dispensing outlet disposed on and extending through the ice dispenser housing for discharging ice received from the dispenser post out the ice dispenser assembly.

15. The dispensing system according to claim 14, wherein the ice dispenser assembly further comprises an ice dispenser channeling element for carrying ice through the ice dispenser assembly disposed in the ice dispenser housing and in cooperative engagement with the ice channeling element of the movable ice gate assembly.

16. The dispensing system according to claim 15, wherein the dispenser post includes:

an ice dispenser post opening for facilitating ice transfer from the ice dispenser post to the ice dispensing outlet; and an ice dispenser trap door in cooperative engagement with the ice dispenser post opening for selectively regulating ice flow through the ice dispenser post opening.

17. The dispensing system according to claim 16, further comprising a logic control unit for selectively engaging the ice channeling element, the trap door, the ice dispenser channeling element, and the ice dispenser trap door to facilitate ice delivery from the ice supply unit and the ice dispenser unit.

18. The dispensing system according to claim 4, further comprising a dispensing system ice storage unit coupled with the movable ice gate assembly of the ice supply unit for receiving ice therefrom.

19. The dispensing system according to claim 18, further comprising a sanitizing system in cooperative engagement with the ice supply unit and the dispensing system ice storage unit for preventing the unfavorable build-up of contaminants therein.

20. The dispensing system according to claim 7, further comprising a water treating system coupled with the automatic ice maker assembly for supplying treated water thereto.

21. An ice supply unit, comprising:

an ice supply unit housing;

an ice collection bin disposed in the ice supply unit housing for receiving ice; and an automatic ice maker assembly positioned within the collection bin for supplying ice thereto, wherein the automatic ice maker assembly comprises an L-shaped evaporator coil positioned along the periphery of the ice collection bin for facilitating the formation of ice thereof.

22. A method of configuring a dispensing system to increase ice supply thereto, comprising the steps of:

positioning an ice supply unit adjacent to a dispensing system ice storage unit, the ice supply unit including a post for channeling ice therethrough;

coupling a movable ice gate assembly with the post of the dispensing system ice storage unit, the movable ice gate assembly comprising a movable gate unit including an ice applicator chute having a chute sleeve extendible therefrom;

moving the movable gate unit about the post to align the ice applicator chute with an opening into the dispensing system ice storage unit; and extending the chute sleeve from the ice applicator chute into the opening into the dispensing system ice storage unit to permit the transport of ice from the ice supply unit to the dispensing system ice storage unit.

* * * * *